United States Patent [19]

Veale

[11] Patent Number: 4,501,094

[45] Date of Patent: Feb. 26, 1985

[54] WORKPIECE PROFILE-FOLLOWING CONTROL SYSTEM FOR CONDITIONING GRINDERS

[75] Inventor: John P. Veale, Snohomish County, Wash.

[73] Assignee: Western Gear Machinery Co., Everett, Wash.

[21] Appl. No.: 443,168

[22] Filed: Nov. 22, 1982

[51] Int. Cl.[3] ..... B24B 7/02

[52] U.S. Cl. ..... 51/165.71; 51/165.92; 51/34 C; 51/45

[58] Field of Search ..... 51/34 R, 34 C, 34 A, 51/165.71, 165.92, 35, 45, 327; 364/474

[56] References Cited

U.S. PATENT DOCUMENTS

| | | | |
|---|---|---|---|
| 2,073,786 | 3/1937 | Doutt | 51/34 A |
| 3,134,204 | 5/1964 | Lella | 51/45 |
| 3,953,943 | 5/1976 | Nakaoka | 51/165.92 |
| 4,100,700 | 7/1978 | Peirce et al. | 51/165.71 |
| 4,112,626 | 9/1978 | Watanabe et al. | 51/35 |
| 4,248,019 | 2/1981 | Hawley et al. | 51/165.77 |
| 4,370,721 | 1/1983 | Berenberg et al. | 364/474 |

FOREIGN PATENT DOCUMENTS

| | | | |
|---|---|---|---|
| 41157 | 3/1982 | Japan | 51/34 C |

*Primary Examiner*—Frederick R. Schmidt
*Assistant Examiner*—Robert A. Rose
*Attorney, Agent, or Firm*—Seed and Berry

[57] ABSTRACT

A control system for a workpiece conditioner grinder that compensates for bowing or curvature of the workpiece. The curvature of the workpiece is initially determined by recording a set of grinding wheel position measurements when the grinding wheel is contacting the upper surface of the workpiece. These measurements are used to calculate offsets from a fixed plane of reference, and the offsets are summed with vertical grinding wheel position command signals generated while the grinding wheel is grinding the sides of the workpiece. The vertical position of the grinding wheel is thus modified by the offset in order to cause the grinding wheel to remove material in a longitudinally extending strip having a curvature conforming to the curvature of the workpiece. Alternatively, the offset signal may be generated in real time and summed with the vertical position command signal.

6 Claims, 5 Drawing Figures

WORKPIECE PROFILE-FOLLOWING CONTROL SYSTEM FOR CONDITIONING GRINDERS

TECHNICAL FIELD

This invention relates to grinding machinery for workpieces, such as billets, and more particularly, to a system for maintaining a grinding wheel in contact with a surface of a workpiece despite bowing or deformation of an adjacent surface of the workpiece.

BACKGROUND ART

The need exists in a large number of fields to perform grinding operations on workpieces. For example, a billet is often the raw material for a rolling process in which the billet is flattened and formed into a finished product. These billets often contain surface imperfections which, if not removed, are carried through to the finished product. Accordingly, these imperfections are normally removed in a grinding process called "spotting" in which a rotating grinding wheel is held against the surface imperfection until the surface imperfection is removed. The surfaces of billets are also normally coated with a layer of oxides and other material. This surface layer must also be removed in order to prevent the surface layer from degrading the quality of the finished product. The surface layer is normally removed in a process called "skinning" in which the billet reciprocates beneath the grinding wheel while the grinding wheel is held in contact with the billet. The skinning process is often performed automatically. The grinding pressure of the wheel against the workpiece is automatically controlled while the workpiece reciprocates back and forth adjacent the grinding wheel, and the grinding wheel steps across the workpiece an incremental distance each grinding pass.

The automatic skinning process is generally performed only on the top surface of the workpiece. In order to grind all four surfaces of a rectangular workpiece, the workpiece is sequentially rotated from one surface to the next so that the surface to be skinned is facing upwardly.

Grinding the upper surface of a workpiece is relatively straightforward since the grinding force exerted by the grinding wheel in a downward direction can be adjusted by a control signal derived from such parameters as a horsepower or grinding force. It is possible to use such techniques even though the workpiece is curved or bowed upwardly since the grinding wheel is automatically moved in a vertical direction to maintain the horsepower, grinding force, or other parameter at a target value. In contrast, grinding the sides of a workpiece presents problems not encountered with grinding the top surface of the workpiece. Although operating parameters such as grinding power or grinding force can be used to control actuators moving the grinding wheel in a horizontal direction, bowing of the workpiece in a vertical direction prevents the grinding wheel from uniformly contacting the sides of the workpiece. In other words, for a workpiece that is bowed upwardly, a grinding wheel having a constant vertical position would contact the upper portion of the workpiece side at the ends of the workpiece, but it might contact the lower portion of the side at the center of the workpiece. Although workpiece grinders having these characteristics are sometimes used, the nonuniformity in the manner that the grinding wheel contacts the workpiece degrades the quality of the automatic skinning process.

Although conventional grinding operations are being described in some detail with respect to billets, it will be understood that the principles of the invention applicable to billets are also equally applicable to other grinding processes.

DISCLOSURE OF INVENTION

It is an object of the invention to provide a system for controlling the operation of a conditioner grinder that is especially adapted to grind workpieces that are curved about an axis normal to the surface being ground.

It is another object of the invention to provide a conditioner grinder that is capable of grinding a plurality of sides of a workpiece without rotating the workpiece as eachside is ground.

It is a further object of the invention to provide a conditioner grinder which is automatically programmed while skinning one surface of a workpiece to compensate for bowing of the workpiece while skinning an adjacent surface of the workpiece.

These and other objects of the invention are provided by a control system for a conditioner grinder in which relative movement between the grinding wheel and the workpiece occurs in a longitudinal direction along the length of the workpiece, in a transverse direction perpendicular to the longitudinal axis of the workpiece and parallel to the surface of the workpiece to be ground, and in a normal direction perpendicular to the surface to be ground. In operation, the grinding wheel sequentially removes longitudinal strips of material from the surface to be ground as the wheel sequentially indexes in the transverse direction across the surface. In order to compensate for curvature of the workpiece about an axis extending along the normal direction, the inventive control system applies an offset to the grinding wheel in the transverse direction. The offset corresponds to the curvature of the workpiece so that the longitudinal strips removed by the grinding wheel are curved to conform to the curvature of the workpiece. The curvature of the workpiece may be determined by measuring in the transverse direction of a surface adjacent to the surface to be ground, preferably during the grinding of that surface, by recording the position of the grinding wheel. This results in a set of offsets taken at points along the longitudinal axis of the workpiece. The offsets are then summed with an indexing signal controlling the position of the grinding wheel in the transverse direction, with the offset being selected by measuring the longitudinal position of the workpiece with respect to the grinding wheel. Alternatively, the curvature may be determined in real time by continuously sensing the position in the transverse direction of a surface adjacent to the surface to the be ground at a point opposite the grinding wheel. This results in a continuously generated offset signal that is applied to the indexing signal to compensate for the curvature of the workpiece.

BEST MODE FOR CARRYING OUT THE INVENTION

Figure 1:
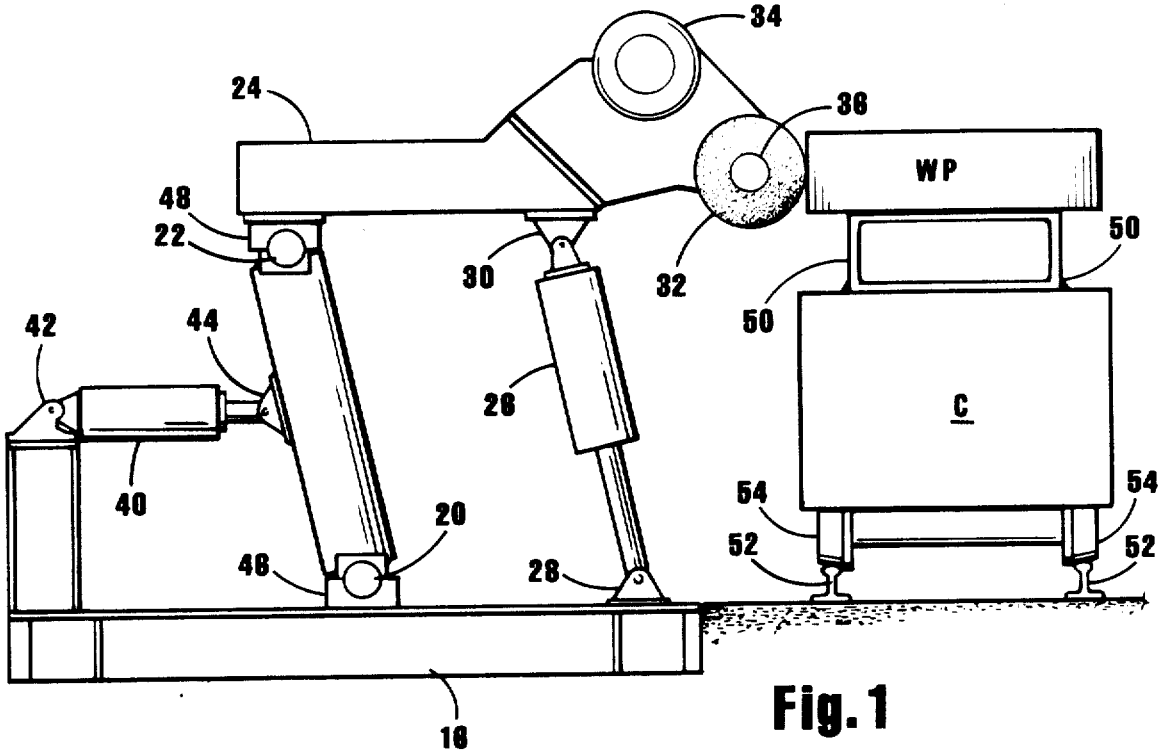
FIG. 1 is an end elevational view in schematic form of a typical apparatus for grinding a workpiece such as a billet.
Figure 2:
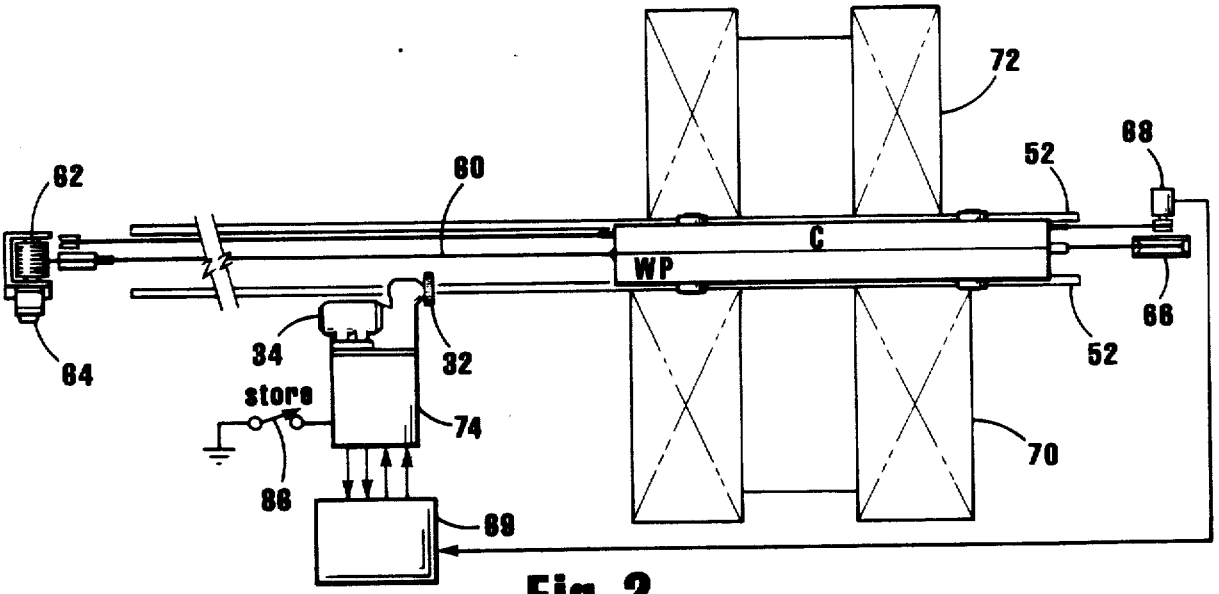
FIG. 2 is a top plan view of the grinding apparatus of FIG. 1.

A typical apparatus for grinding workpieces, such as billets, is illustrated in FIGS. 1 and 2. With reference to FIG. 1, the apparatus includes a stationary, rigid floor frame 16, from which a support 18 is pivotally mounted at 20. The opposite end of the pivotal support 18 is pivotally secured at 22 to a horizontally disposed grinding wheel support arm 24. A conventional hydraulic actuator 26 is also pivotally mounted to the floor frame 16 at 28 and to the grinding wheel support arm 24 at 30. Although the distance between the pivotal connections 28,30 is varied by the actuator 26, the adjustment is relatively slight so that the pivotal support 18 and hydraulic actuator 26 somewhat approximate a parallelogram. A grinding wheel 32 mounted on a motor 34 through a spindle 36 is carried at the end of the horizontally disposed grinding wheel support arm 24. Hydraulic fluid flowing into and out of the hydraulic actuator 26 in a conventional manner produces primarily vertical movement of the grinding wheel 32.

The structure of the support 18 and hydraulic actuator 26 cause a second hydraulic actuator 40 to produce primarily horizontal movement of the grinding wheel 32. The hydraulic actuator 40 is pivotally connected to the floor frame 16 at 42 and to the pivotal support 18 at 44.

The rotational positions of the pivotal support 18 with respect to the frame 16 and the support arm 24 are sensed by conventional rotary encoders 46,48, respectively. As explained in detail below, these encoders 46,48 allow the position of the grinding wheel 32 to be constantly determined as the actuators 26,40 vary the positions of the pivotal support 18 and support arm 24.

During grinding, the workpiece WP is carried by a manipulator car C and is securely held thereon by clamp members 50. The car C is supported on rails 52 by a pair of wheels 54. The car C and, hence, the workpiece WP reciprocate beneath the grinding wheel 32 as the car C moves along the rails 52. As illustrated in further detail in FIG. 2, a cable 60 connected to one end of the carriage C engages a drum 62 which is rotated by a hydraulic motor 64 in accordance with a control signal in a conventional manner. The cable 60 extends beneath the rails 52 and engages a freely rotating sheave 66 at the other end of the rails 52. Thus, rotation of the drum 62 moves the carriage C along the rails 52. The position of the car C and, hence, the workpiece WP with respect to the grinding wheel 32, is measured by a rotary encoder 68 rotating with the drum 62.

The grinding system as described above is conventional and is described in greater detail in U.S. Pat. No. 4,248,019, which is incorporated herein by reference. The output of the encoder 68, as well as the outputs of the encoders 46,48 (FIG. 1) for sensing the position of the grinding wheel 32, are applied to a conventional computer 69 operating under a program of instructions described in detail below. The computer generates outputs to respective conventional servo valves (not shown) which control the flow of hydraulic fluid to the actuators 26,40 in a manner well known to those skilled in the art.

In conventional operation, a workpiece WP, such as a billet, is initially placed on a conventional charge table 70. The carriage C is then moved along the rails 52 and the workpiece WP is loaded onto the carriage C by conventional handling means. The carriage C then moves toward a position beneath the grinding wheel 32 and the grinding wheel 32 is lowered into contact with one of the exposed surfaces of the workpiece WP. The workpiece WP then reciprocates back and forth beneath the grinding wheel 32. The hydraulic actuator 40 is primarily energized to control the force exerted by the grinding wheel 32 against the vertical surface of the workpiece WP.

The hydraulic actuator 26 is energized primarily to step or "index" the grinding wheel vertically across the surface to be ground after each grinding pass. When the grinding wheel 32 is being used to grind the upper surface of the workpiece WP, the actuators 26,40 will reverse roles, with the actuator 26 controlling the grinding force and the actuator 40 indexing the grinding wheel 32 across the surface to be ground. After the vertical surface of the workpiece WP nearest the grinding wheel 32 and the upper surface of the workpiece WP have been ground, the workpiece WP is turned over to expose the other two surfaces of the workpiece WP to the grinding wheel 32. The grinding wheel 32 could, of course, be used to grind only one surface (horizontal or vertical), with the workpiece WP being turned 90° after each surface is ground.

After grinding, the carriage C is moved along the rails 52 to a discharge position, where the workpiece WP is loaded onto a conventional discharge table 72 by conventional handling means. The entire operation of the system is controlled in a conventional manner, either manually or semiautomatically, by an operator in a cab 74, as is well known to those skilled in the art. One such workpiece grinding system is disclosed in previously mentioned U.S. Pat. No. 4,248,019.

The above-described grinding apparatus is one design used to grind elongated workpieces, such as billets. However, other types of grinding apparatus are also used to perform grinding operations on workpieces of various types. Thus, although the inventive control system is described with reference to the grinding apparatus of FIGS. 1 and 2, it will be understood that the inventive control system can also be used with other grinding apparatuses.

Figure 3:
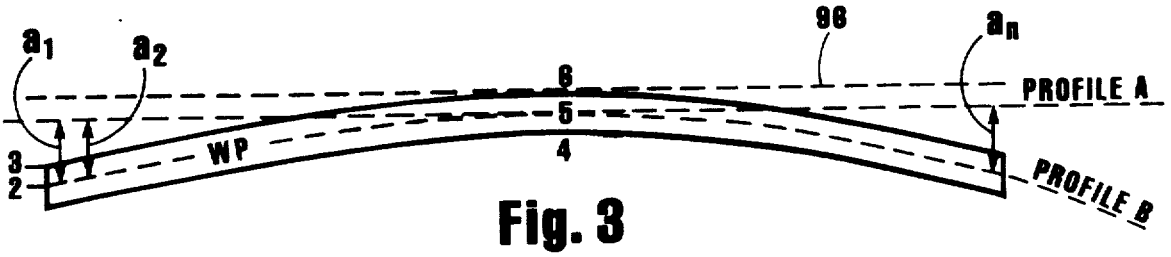
FIG. 3 is a horizontal elevational view showing a workpiece having a curved or bowed configuration and illustrating the basic concept of the inventive control system.

FIG. 3 shows a typical workpiece, such as a slab, bloom, or billet. The workpiece is shown in profile or elevational view in the position illustrated in FIG. 1. Thus, it is the vertical side surface of the workpiece WP that is being ground. It will be apparent that the workpiece WP is vertically bowed in that it is markedly curved about an axis that extends in the horizontal direction. Under normal operation, as explained above, the carriage C would reciprocate in front of the grinding wheel 32, thereby allowing the grinding wheel 32 to remove a horizontal strip of material from the side surface of the workpiece WP. The grinding wheel 32 would be "indexed" or moved vertically in stepped increments after each grinding pass, thereby sequentially removing the surface layer of the workpiece in a series of horizontal strips.

The above procedure is satisfactory for workpieces that are relatively flat and are thus not significantly curved about an axis extending normal to the surface to be ground. However, when the workpiece WP is curved about an axis extending normal to the surface to be ground, as illustrated in FIG. 3, a constant vertical position of the grinding wheel 32 would cause the grinding wheel to remove material from the workpiece along the line indicated by "Profile A." Operation of the conditioner grinder under these circumstances is unsatisfactory for a number of reasons. For example, toward the ends of the workpiece WP, the grinding wheel 32 is positioned above the workpiece WP. Under these circumstances, the grinding wheel 32 could easily move horizontally above the workpiece so that when the workpiece reverses direction, the workpiece would contact the top surface and not the side surface of the workpiece WP. Also, the grinding wheel 32 would remove more material near the edge of the workpiece WP, thus producing a nonuniform depth of removal on the side surface of the workpiece WP. While the problem is being discussed with reference to grinding the sides of workpieces having a vertical bow, it will be understood that the problem also exists in grinding the upper surface of a workpiece having a horizontal bow.

The inventive control system solves the aforementioned problems by recording the curvature of the workpiece WP by recording a set of measurements indicative of the distance from a reference line or plane, such as "Profile A," to a measurement line or plane, such as "Profile B," that is curved in the same manner as the workpiece WP. The measurements can be made during grinding of the upper surface of the workpiece WP by recording the position of the grinding wheel 32 at spaced-apart points along the length of the workpiece WP. The result is a set of measurements $A_1, A_2 \ldots A_n$ that indicate the curvature of the workpiece WP from a plane of reference. Once the curvature measurements $A_1, A_2 \ldots A_n$ have been obtained, they can be summed with position command signals controlling the vertical position of the grinding wheel 32 as the workpiece WP moves during each grinding pass. As a result, these curvature measurements are used as offsets to cause the grinding wheel 32 to follow the curved line "Profile B" instead of the horizontal line "Profile A." Individual curvature measurements are selected by noting the position of the workpiece, as indicated by the position encoder 68, to determine the portion of the workpiece WP opposite the grinding wheel 32. The curvature measurement for that portion of the workpiece WP is then summed with the vertical position command signal to the actuators 26,40 to ensure the correct vertical position of the grinding wheel 32. The vertical position of the grinding wheel 32 is calculated from signals output by the encoders 46,48 by the computer 69. The computer 69 also determines the position of the workpiece WP from the output of the encoder 68. The computer 69 then records the vertical position of the grinding wheel 32 at specific locations while grinding the upper surface of the workpiece WP. The computer 69 then generates respective offset signals for servo valves controlling the actuators 26,40 when the side of the workpiece WP is being ground.

Figure 4:
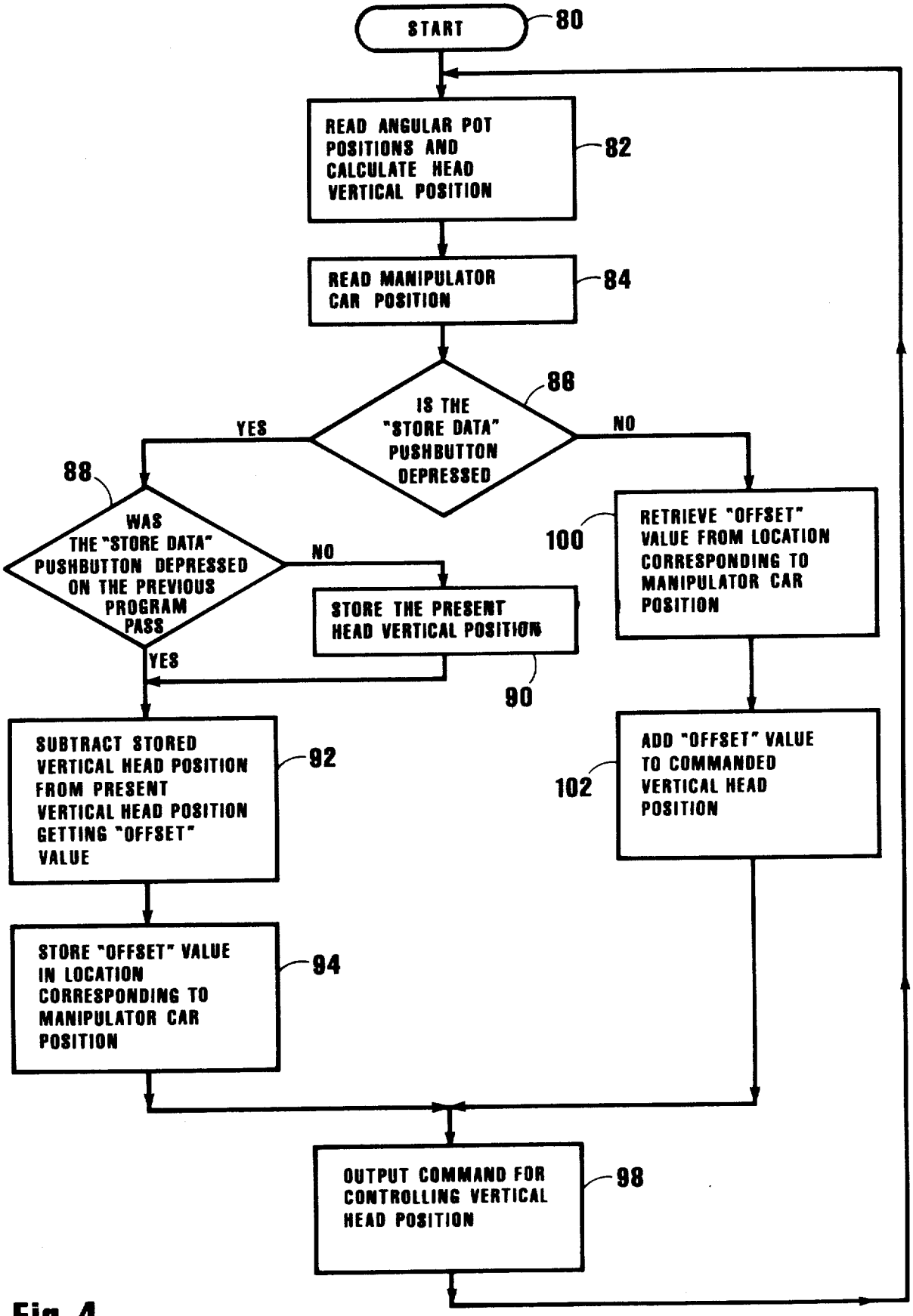
FIG. 4 is a flow chart of the software controlling the operation of a portion of the hardware illustrated in FIG. 2.

The software for controlling the operation of the computer 69 is illustrated in FIG. 4. The program is entered at 80 and proceeds to 82, where the outputs of the potentiometers 46,48 are read, and the vertical position of the grinding wheel 32 corresponding to the angular positions is calculated in accordance with known geometric principles. The position of the manipulator car C is then calculated at 84 from the output of the potentiometer 68. If a store data pushbutton 86 (FIG. 2) is closed, this fact is detected at 86 to cause the program to branch to 88, where the timing of the closure of switch 86 is examined. If the switch 86 is now closed, but was not closed on a previous grinding pass, the operator has just closed the store switch 86 to cause the system to measure the curvature of the workpiece WP during the current grinding pass. Accordingly, if the store switch 86 is found at 88 to have not been previously closed, the program stores a set of grinding wheel position measurements at 90, along with an indication of the position of the workpiece WP at the point where the measurement is taken. The grinding wheel 32 is then moved to the starting location for grinding the sides of the workpiece WP. The vertical position of the grinding wheel 32 is then measured at 92 and subtracted from each stored vertical position measurement to provide the offsets $A_1, A_2 \ldots A_n$, which should be added to or subtracted from the vertical position command signals during each grinding pass while grinding the sides. These offset values are then stored at 94.

The manner in which the offset values are obtained at 92 is better understood with reference to FIG. 3. Assuming that the vertical position of the grinding wheel 32 is an arbitrary value "6" at the center of the top surface of the workpiece WP, the value "6" is stored at 90 for the midpoint of the workpiece WP. Assuming, also, that the initial position for grinding the sides of the workpiece WP is at the upper edge of the workpiece WP at its longitudinal midpoint, the vertical position measurement taken at 92 will be "6", thereby yielding an offset of "0". The measurement taken at 92 thus establishes a line or plane of measurement 96 corresponding to a vertical position of "6". The vertical position measurement of "3" for the left end of the workpiece WP yields of an offset of "−3". Thus, when the grinding wheel 32 has indexed down to the "5" position at the center of the workpiece, and the command signal thus calls for a height of "5" throughout the entire length of the workpiece, the offset of "−3" at the left end of the workpiece WP will result in an overall command signal of "5 minus 3", or "2", to position the grinding wheel 32 at the vertical midpoint of the workpiece WP.

After all of the offsets have been stored at 94, the computer 69 outputs a command at 98 before returning to 82.

Upon returning, the vertical position of the grinding wheel 32 is once again read at 82 and the longitudinal position of the workpiece is read at 84. The store switch 86 will no longer be closed, so the program will now branch to 100, where the offset value for the current position of the workpiece that was read at 84 is retrieved. This offset value is then added to the current vertical command at 102 to generate a command signal indicative of the desired position of the grinding wheel to compensate for curvature of the workpiece about an axis normal to the surface being ground. This command is once again output at 98 before returning to 82 to process a new offset corresponding to the new relative position between the workpiece WP and the grinding wheel 32 along the longitudinal axis of the workpiece WP. The signals for controlling the grinding force of the grinding wheel 32 and for indexing the grinding wheel 32 across the surface to be ground are generated in a conventional manner, such as described in previously mentioned U.S. Pat. No. 4,248,019.

Figure 5:
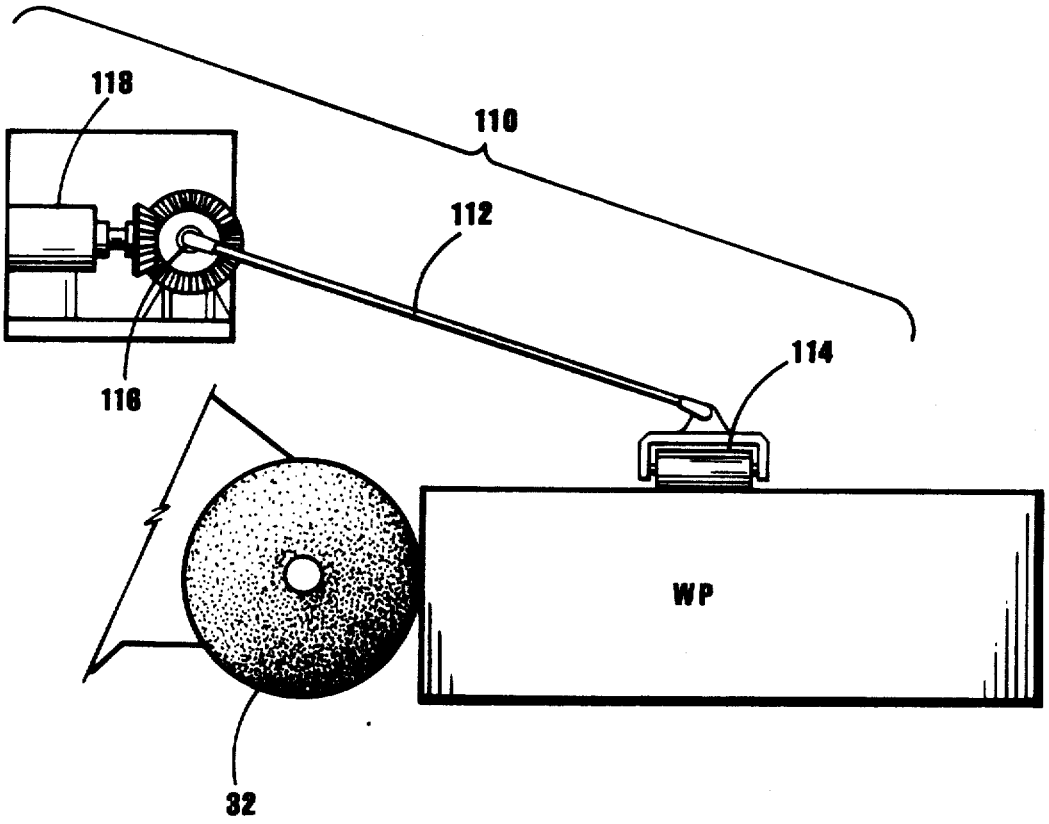
FIG. 5 is a schematic illustration of an alternative approach to generating offset signals indicative of the curvature of a workpiece.

Although the curvature of the workpiece is preferably compensated for in the manner explained above, it will also be understood that offset signals may be generated in real time utilizing a variety of techniques, such as that illustrated in FIG. 5. In this alternative embodiment, a sensing device 110 is positioned directly opposite the workpiece 32 for measuring the vertical position of the top surface of the workpiece at the same longitudinal position of the workpiece currently being ground by the grinding wheel 32. The sensing device may include a feeler arm 112 having a roller 114 continuously contacting the upper surface of the workpiece WP. The feeler arm 112 is pivotally mounted at 116. The rotational position of the arm 112 is measured by a conventional rotary encoder 118 or potentiometer. The output of the encoder 118 thus continuously generates an offset that can be summed with the command signal to cause the grinding wheel 32 to follow a curved path corresponding to the curvature of the workpiece.

As mentioned above, although the grinding wheel 32 is described as being used for grinding the vertical sides of the workpiece WP, it will be understood that the same principle applies to grinding the upper surface of the workpiece WP when the workpiece WP is curved about a vertical axis extending normal to the upper surface being ground.

I claim:

1. A control system for a conditioner grinder for grinding elongated workpieces, said system comprising:

actuator means for moving said grinding wheel in a first direction normal to a surface of the workpiece to be ground and in a second direction parallel to the surface to be ground and perpendicular to the longitudinal axis of the workpiece;

first transducer means for measuring an operating parameter of said grinding wheel;

first control means receiving an output from said first transducer means for controlling said actuator means to maintain said operating parameter at a predetermined value;

workpiece manipulation means for reciprocatingly moving said workpiece along its longitudinal axis with respect to said grinding wheel during a plurality of grinding passes;

gauging means for determining the curvature of said workpiece about an axis perpendicular to the surface of said workpiece being ground and for generating a signal indicative of the curvature-induced offset of said workpiece at a location on said workpiece adjacent said grinding wheel as said workpiece longitudinally moves with respect to said grinding wheel during each grinding pass; and second control means receiving the curvature indication from said gauging means for controlling said actuator means to move said grinding wheel in said second direction by an amount corresponding to said curvature indicative signal, thereby compensating for any curvature in said workpiece about an axis normal to the surface of said workpiece being ground.

2. The system of claim 1 wherein said gauging means comprise:

workpiece position transducer means for determining and generating a workpiece position signal indicative of the position of said workpiece with respect to said grinding wheel along the longitudinal axis of said workpiece;

grinding wheel position transducer means for determining and generating a grinding wheel position signal indicative of the position of said grinding wheel in said second direction;

memory means receiving said workpiece position signal and said grinding wheel position signal for recording the position of said grinding wheel and said workpiece while said grinding wheel is in contact with a surface of said workpiece adjacent the surface to be ground, thereby generating a record of the curvature of the surface adjacent to the surface to be ground; and compensating means responsive to said memory means and said workpiece position transducer means for controlling said actuator means to move said grinding wheel in said second direction as said workpiece moves with respect to said grinding wheel along its longitudinal axis, the magnitude of movement in said second direction at each position of said workpiece being proportional to the grinding wheel position signal at the corresponding position of said workpiece.

3. The system of claim 2, further including indexing means operatively associated with said actuator means for selectively moving said grinding wheel in said second direction across the surface of said workpiece being ground to successively remove longitudinally extending strips of material from said surface, the movement of said grinding wheel in said second direction caused by said indexing means being summed with the movement of said grinding wheel in said second direction caused by said compensating means, thereby causing the longitudinally extending strips removed by said grinding wheel to have a curvature conforming to the curvature of said workpiece about an axis extending in said first direction.

4. The system of claim 1 wherein said gauging means comprise:

measuring means positioned adjacent said grinding wheel for measuring and providing a position signal indicative of the position in said second direction of a surface of said workpiece adjacent the surface to be ground; and compensating means responsive to said measuring means for controlling said actuator means to move said grinding wheel in said second direction as said workpiece moves with respect to said grinding wheel along its longitudinal axis, the magnitude of movement in said second direction being proportional to the position signal from said measuring means.

5. The system of claim 4, further including indexing means operatively associated with said actuator means for selectively moving said grinding wheel in said second direction across the surface of said workpiece being ground to successively remove longitudinal strips of material from said surface, the movement of said grinding wheel in said second direction caused by said indexing means being summed with the movement of said grinding wheel in said second direction caused by said compensating means, thereby causing the longitudinally extending strips removed by said grinding wheel to have a curvature conforming to the curvature of said workpiece about an axis extending in said first direction.

6. In a workpiece conditioner grinder having a grinding wheel mounted on a movable support, including means for providing an electrical indication of the position of said grinding wheel, actuator means for producing relative movement between said grinding wheel and said workpiece, said relative movement having components extending in a longitudinal direction parallel to the longitudinal axis of said workpiece, in a transverse direction extending perpendicular to the longitudinal axis of said workpiece and parallel to the surface of said workpiece to be ground, and in a normal direction extending perpendicular to the surface to be ground, and control means for controlling the operation of said actuator means so that said grinding wheel sequentially removes longitudinally extending strips of material from the surface to be ground as said grinding wheel indexes in said transverse direction across the surface to be ground, a system for compensating for curvature of said workpiece about an axis extending along said normal direction by applying an offset to said grinding wheel in said transverse direction, said offset corresponding to the curvature of said workpiece with respect to a plane of reference so that the longitudinally extending strips removed by said grinding wheel conform to the curvature of said workpiece about the axis extending in said normal direction, said compensating system comprising:

indexing means for generating a transverse position signal applied to said actuator means for controlling the transverse position of said grinding wheel;

measuring means for determining the curvature of said workpiece about the axis extending along said normal direction and for recording a set of electrical curvature indications of the distance between a straight reference line and a line conforming to the curvature of said workpiece about an axis extending along said normal direction, each indication of said set of curvature indications corresponding to a respective measurement location along the longitudinal axis of said workpiece;

workpiece position transducer means for selecting as said offset an electrical curvature indication for a measurement location along the longitudinal axis of said workpiece that is adjacent a reference point that is fixed with respect to said grinding wheel; and summing means for adding said offset to said transverse position signal before said transverse position signal is applied to said actuator means.

* * * * *